US006400361B2

(12) United States Patent
Toffolo

(10) Patent No.: US 6,400,361 B2
(45) **Date of Patent: *Jun. 4, 2002**

(54) GRAPHICS PROCESSOR ARCHITECTURE EMPLOYING VARIABLE REFRESH RATES

(75) Inventor: Daniel Toffolo, Wilton, CT (US)

(73) Assignee: United Technologies Dearborn, Inc, Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,468

(22) Filed: Apr. 23, 1998

(51) Int. Cl.[7] ..... G09G 5/00
(52) U.S. Cl. ..... 345/213; 345/545; 348/440.1
(58) Field of Search ..... 345/1.1, 3.2, 196, 345/507, 212, 509, 213, 545, 547, 552; 348/714–716, 718, 440.1

(56) References Cited

U.S. PATENT DOCUMENTS 5,450,130 A * 9/1995 Foley ..... 348/391
5,568,165 A 10/1996 Kimura
5,764,201 A * 6/1998 Ranganathan ..... 345/3
5,874,928 A * 2/1999 Kou ..... 345/1
5,909,225 A * 6/1999 Schinnerer et al. ..... 345/509
5,991,883 A * 11/1999 Atkinson ..... 713/300
6,028,586 A * 2/2000 Swan et al. ..... 345/581
6,054,980 A * 4/2000 Eglit ..... 345/204
6,108,015 A * 8/2000 Cross ..... 345/519
6,123,733 A * 9/2000 Dalton ..... 703/5

FOREIGN PATENT DOCUMENTS

EP 0 228 135 7/1987
EP 09 325729 3/1998

* cited by examiner

*Primary Examiner*—Steven Saras
*Assistant Examiner*—Amr Awad
(74) *Attorney, Agent, or Firm*—Niro, Scavone, Haller & Niro

(57) ABSTRACT

The display system includes a display controller which renders text and graphics and writes it to the RAM. The display controller then reads the rendered information from the RAM and activates a display based upon that information. Generally the display controller reads information from the display controller and activates the display at a constant refresh rate; however, when a large number of text and/or graphics to be rendered have accumulated, the display controller temporarily reduces the refresh rate in order to render and write the text and/or graphics to the RAM.

7 Claims, 1 Drawing Sheet

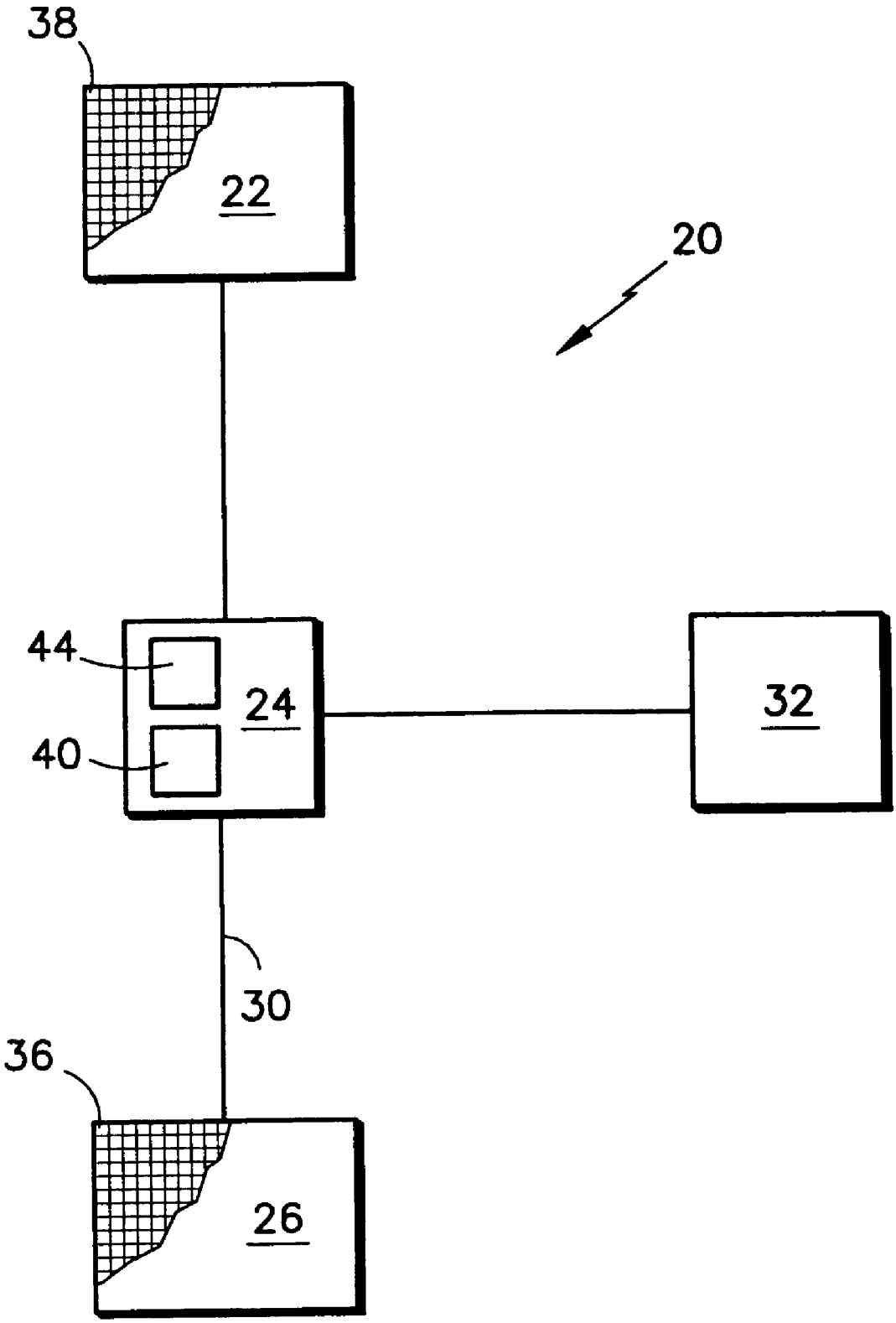
38
22
20
44
24
40
32
30
36
26

GRAPHICS PROCESSOR ARCHITECTURE EMPLOYING VARIABLE REFRESH RATES

BACKGROUND OF THE INVENTION

The present relates to a display system and more particularly to a display system having an improved architecture for a graphics processor utilizing a single-port RAM.

Known display systems include a display controller driving a display having a matrix of pixels at a fixed refresh rate. The display controller drives the pixels based upon information stored in RAM or VRAM. Typically, between 4 and 32 bits of information are associated with each pixel in the display. The display controller is also a graphics processor which receives information, such as text or graphics-information, indicating text or graphics to be rendered and written into the RAM. After the text and graphics are written into the RAM, the display controller reads the rendered information from the RAM and activates the pixels in the display accordingly.

In order to reduce cost, a single-port RAM may be utilized. The single-port RAM cannot be written to and read from simultaneously. Further, the display controller will be accessing the RAM at a certain rate to maintain the refresh rate. Therefore, the amount of text and graphics which can be rendered and written to RAM in a given period of time is limited. As a result, there may be periods of significant delay before a large amount of text or graphics appear on the display.

SUMMARY OF THE INVENTION

The present invention provides a display system having a display controller which utilizes a single-port RAM. The display controller, based upon graphics and text codes from an external source, such as CPU, renders text and/or graphics and writes this information to the RAM. The display controller also reads information from the RAM and activates pixels on display based upon the information in the RAM.

Generally, the display controller reads from the RAM and activates pixels in the display at a constant refresh rate. However, when the number of text and/or graphics to be rendered by the display controller exceeds a predetermined threshold or has been delayed for a predetermined time period, the display controller reduces the refresh rate of the display, thereby permitting the display controller to render the text and/or graphics and write the rendered information to the RAM. When the display controller renders the text and/or graphics which have accumulated, the display controller returns to the original, higher refresh rate.

In this manner, a single port RAM can be utilized without significant reduction in display quality. The temporary reduction in refresh rate will be less noticeable than a significant delay in graphics and text rendering.

BRIEF DESCRIPTION OF THE DRAWING

The above, as well as other advantages of the present invention, will become readily apparent to those skilled in the art from the following detailed description of a preferred embodiment when considered in the light of the accompanying drawing in which:

FIG. 1 is a schematic of the display system of the present invention.

DETAILED DESCRIPTION OF THE PREFERRED EMBODIMENT

A display system 20 according to the present invention includes a display 22, such as an ELD, activated by a display controller 24. The display controller 24 reads and writes information to RAM 26, such as the RAM, via a single port 30. The display controller 24 also receives graphics and text codes from an external source, such as a CPU 32. The codes indicate text and/or graphical information to be rendered by the display 24 and written to the RAM 26.

The RAM 26 generally comprises a matrix of information 36, each comprising between several bits or several bytes, each associated with a pixel 38 in a matrix of pixels 38 in display 22. The display controller 24 activates the pixels 38 in the display 22 based upon information in the associated bytes 36 in the RAM 26. The display controller 24 generally activates the pixels 38 in the display 22 at a generally constant, fixed first refresh rate, such as 120 Hertz. The display controller 24 includes a controller 40, such as a microprocessor, and a local memory 44 having software run by the controller 40 to provide the features described herein.

The display controller 24 receives graphics and text codes from the CPU 32, indicating text and/or graphics to be rendered by the display controller 24. The codes may be stored in the memory 44 prior to being rendered by the controller 40 of the display controller 24. If a predetermined amount of text and/or graphics to be rendered accumulate in the memory 44, the display controller 24 reduces the refresh rate of the display 22. During this time, the display controller 24 reduces the refresh rate temporarily, preferably not less than the critical flicker frequency and preferably by ½ to approximately 60 hertz. This also reduces the frequency at which the display controller 24 will have to read the RAM 26 via the single port 30 to refresh the display 22. As a result, there is more time between the read cycles in which the display controller 24 can utilize the single port 30 to write the rendered text and/or graphics to the RAM 26 more promptly. It should be noted that each read cycle would still take the same amount of time during either mode, since there is the same amount of information to be read, but the read cycles would occur less frequently.

The use of the single port RAM 26 decreases the cost of the display system 20. The temporary reduction in refresh rate may not be significantly noticeable, and according to the technique described above, the rendering of text and/or graphics by the display controller 24 will not be delayed by the use of the single port RAM 26.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A display system comprising:

a display having a matrix of pixels;

a single port memory having a matrix of information, each associated with one of said pixels;

a display controller writing display information to said memory, said display controller reading said display information and activating said display based upon said display information at a flicker frequency refresh rate, said display controller dynamically reducing said flicker frequency refresh rate when a quantity of display information to be written to said memory increases above a threshold quantity.

2. The display system of claim 1 wherein said display controller renders graphics, said rendered graphics comprising said display information.

3. The display system of claim 2 wherein said display controller reduces said refresh rate based upon a quantity of graphics to be rendered.

4. The display system of claim 1 wherein said display is an ELD.

5. A method for driving a display including the steps of:

writing display information to a single port memory;

reading said display information from the memory;

activating a display based upon said display information at a flicker frequency refresh rate; and dynamically reducing said flicker frequency refresh rate when a quantity of said display information to be written increases above a threshold quantity.

6. The method of claim 5 further including the steps of:

receiving a code; and rendering graphics based upon said code, said display information comprising said rendered graphics.

7. The method of claim 5 further including the steps of:

activating said display at a first refresh rate when there are no graphics to be rendered; and activating said display at a second refresh rate less than said first refresh rate when a quantity of graphics to be rendered exceeds a predetermined threshold.

* * * * *